US005096500A

United States Patent [19]

San Miguel Bento

[11] Patent Number: 5,096,500

[45] Date of Patent: Mar. 17, 1992

[54] PROCESS FOR DECOLORIZATION AND DECALCIFICATION OF SUGAR SOLUTIONS

[75] Inventor: Luis R. San Miguel Bento, Matosinhos, Portugal

[73] Assignee: Rar-Refinarias de Acucar Reunidas, S.A., Porto, Portugal

[21] Appl. No.: 579,029

[22] Filed: Sep. 7, 1990

[30] Foreign Application Priority Data

Oct. 23, 1989 [PT] Portugal ..... 92-072

[51] Int. Cl.[5] ..... C13J 1/06

[52] U.S. Cl. ..... 127/46.2; 127/46.3

[58] Field of Search ..... 127/46.2, 46.3

[56] References Cited

U.S. PATENT DOCUMENTS

| | | | |
|---|---|---|---|
| 2,366,651 | 1/1945 | Rawlings | 127/46.2 |
| 2,451,272 | 10/1948 | Blann | 127/46.2 |
| 3,715,235 | 2/1973 | Moebes et al. | 127/46.2 |
| 3,762,948 | 10/1973 | Morton et al. | 210/670 |
| 3,961,981 | 6/1976 | Pollio et al. | 127/46.2 |
| 4,065,388 | 12/1977 | Flynn et al. | 210/673 |

*Primary Examiner*—Prince Willis, Jr.
*Assistant Examiner*—P. L. Hailey
*Attorney, Agent, or Firm*—Wenderoth, Lind & Ponack

[57] ABSTRACT

This invention provides a process for decolorization of sugar solutions with simultaneous removal of calcium ions from the solution, using an ion exchange resin. This process may be applied to liquors of cane sugar refineries or juices of beet sugar factories, or other sugar solutions. In this process, the sugar solutions containing anionic colorants and soluble calcium salts are passed through a strong base anionic exchange resin in carbonate form. During decolorization the carbonate ion bound to the fixed ions of the resin are exchanged by the anoinic colorants and they precipitate the soluble calcium in solution. The sugar solution treated by the resin is then filtered. Regeneration of the strong base anioniic resin is also provided. By this process, sugar colorants and calcium ions are removed from sugar solutions in a single operation using only an anionic ion exchange resin. However, a weak base anionic exchange resin can be used, in a separate column, before the strong base resin, as protection for the strong base resin.

10 Claims, No Drawings

PROCESS FOR DECOLORIZATION AND DECALCIFICATION OF SUGAR SOLUTIONS

BACKGROUND OF THE INVENTION

This invention relates to a process for decolorization of sugar solutions with simultaneous removal of calcium ions from the solution using an ion exchange resin.

The removal of part of the calcium ions from the sugar solutions after carbonatation or phosphatation in cane sugar refineries, or after carbonatation in beet sugar factories, is important. In fact, during sugar solution concentration the calcium compounds become insoluble, covering the evaporator heating surfaces, and the thermal yield of the operation is reduced. Moreover, the removal of the calcium ions will improve the sugar solution's purity, resulting in an increase of recoverable sugar during crystallization.

SUMMARY OF THE INVENTION

An object of the present invention is to provide a process for decolorization and decalcification of sugar solutions.

In accordance with the present invention, this object can be achieved by a process wherein the sugar solutions pass through one or more resin columns containing strong base anionic exchange resin appropriate for sugar decolorization. The resin must be used in carbonate form, wherein carbonate ions are bound to fixed ions of the resin.

DESCRIPTION OF THE PREFERRED EMBODIMENTS

More spccifically, the present invention is directed to a process for decolorization and decalcification of a sugar solution, which comprises treating a sugar solution by means of a strong base anionic exchange resin in carbonate form wherein carbonate ions are bound to fixed ions of the resin.

The passing of the sugar solution through the resin can be either in an upward or downward direction according to the technical features of the resin column.

The sugar solution is preferably passed through the column in a flow rate of 1 to 3 tons of dry substance per cubic meter of resin per hour, and preferably at a temperature between 60° and 80° C.

The strong base anionic exchange resin must be prepared in order to have carbonate ions as counter ions, that is, the anions bound to the resin fixed ions must be carbonate ions. Any such strong base anionic exchange resin in carbonate form can be employed in the invention. Examples of such resins include those of polystyrene-divinyl benzene or acrylic-divinyl benzene, with functional groups of trimethyl ammonium, in carbonate form, that is with carbonate ions bound to the fixed ions of the resin. These resins can be obtained by passing through the commercially available resin a solution of sodium carbonate in a concentration of 80 to 100 g/l of $Na_2CO_3$, at a flow rate between 2.0 and 3.0 bed volumes per hour, in a quantity of 3.0 to 5.0 bed volumes and at a temperature between 40° and 60° C.

After having passed through one or more of the columns, the sugar solution is filtered. This removes calcium carbonate precipitate from the solution.

The duration of the resin working cycles will depend on the color and on the amount of calcium salts in the input solutions, as well as on the values required for these parameters in the solution after processing.

It is also possible to employ a weak base anionic exchange resin upstream of the strong base anionic exchange resin, as discussed below in more detail.

Once the working cycle with the strong base anionic exchange resin in processing the sugar solution is completed, such anionic resin, used in this process, is washed and prepared for regeneration, as usual with this kind of ion exchange resin.

Before the regeneration, the anionic resin is submitted to water washes and bubbling up air with pressure, through the resin bed, alternately, until the wash water coming out of the resin bed is clear.

In the process described herein, the strong base anionic exchange resin regeneration is preferably a three step operation: in the first step by means of a dilute acidic solution; in the second step by means of a sodium chloride solution; and in the third step by means of a sodium carbonate solution.

More specifically, during the first regeneration step the calcium carbonate remaining on the resin will be removed. In order to achieve this, the resin is subjected to a bubbling up of carbon dioxide gas, $CO_2$, i.e. upward through the resin bed, with pressure enough to agitate the resin, and also using water. Alternatively, the first regeneration step can be conducted by passing through the resin a solution of hydrochloric acid at a concentration between 1.0 and 10.0 g/l of HCl, at a flow rate of 2.0 to 3.0 resin bed volumes per hour, at a temperature between 20° and 40° C. In both cases, the first regeneration step is carried out until the concentration of calcium in the effluent solution is lower than 200 ppm, expressed as CaO. At regular intervals of working cycles with the sugar solution, e.g. from 50 to 150 cycles, a special acid treatment can be done to the resin. In this treatment, the resin is removed out of the columns and is treated with hydrochloric acid at a concentration between 10 and 60 g/l of HCl, at a temperature between 40° and 60° C., in a separate vessel with agitation, until substantially all of the calcium fixed to the resin is removed, e.g. in an acid:resin volume ratio of at least 2:1, according to the calcium content of the resin.

In the second regeneration step a sodium chloride solution, containing 50 to 120 g/l NaCl, at a pH between 7.0 and 12.0, alkalinized with sodium hydroxide, NaOH, or sodium carbonate, $Na_2CO_3$, or ammonium hydroxide, $NH_4OH$, is passed through the resin in up or down flow direction, at a flow rate between 2.0 and 3.0 resin bed volumes per hour, in a quantity between 1.0 and 4.0 resin bed volumes, and at a temperature between 40° and 60° C.

In the third regeneration step a sodium carbonate solution containing 50 to 100 g/l of $Na_2CO_3$ is passed through the resin, in up or down flow direction, at a flow rate between 2.0 and 3.0 resin bed volumes per hour, in a quantity between 2.0 and 4.0 resin bed volumes, and at a temperature between 40° and 60° C.

The effluent from the last regeneration step can be used as a regenerating agent for regenerating the weak base anionic resin when used before the strong base resin.

The strong base resin is then washed with hot water, in a quantity and flow depending on the resin column design, before the next sugar solution decolorization and decalcification cycle.

As indicated above, a weak base anionic exchange resin can be used before the strong base anionic exchange resin. This serves to protect the strong base resin. Examples of such weak base resin include those of polystyrene-divinyl benzene with functional groups of a tertiary amine, previously treated with a solution of sodium carbonate in a concentration of 40 to 80 g/l of $Na_2CO_3$, at a flow rate between 2.0 and 3.0 bed volumes per hour, in a quantity of 3.0 to 5.0 bed volumes and at a temperature between 40° and 60° C.

I claim:

1. A process for decolorization and decalcification of a sugar solution, which comprises passing a sugar solution through a strong base anionic exchange resin in carbonate form wherein carbonate ions are bound to fixed ions of the resin, at a flow between 1.0 and 3.0 tons of dry substance of the solution per cubic meter of resin per hour and at a temperature between 60° and 80° C., in an up or down flow direction; and regenerating the strong base anionic exchange resin in three steps, in the first step by passing through the strong base anionic exchange resin a hydrochloric acid solution with a concentration between 1.0 and 10.0 g/l of HCl, at a temperature between 20° and 40° C., at a flow rate between 2.0 and 3.0 resin bed volumes per hour, in such an amount to reduce the calcium content in the effluent to a concentration lower than 200 ppm expressed as CaO, in the second step by means of a sodium chloride solution, containing between 50 and 120 g/l NaCl, alkalinized with sodium hydroxide, sodium carbonate or ammonium hydroxide to a pH between 7.0 and 12.0, at a temperature between 40° and 60° C., at a flow rate between 2.0 and 3.0 resin bed volumes per hour, in an upward or downward flow direction, and in a quantity of 1.0 to 4.0 resin bed volumes, and in the third step by means of a sodium carbonate solution containing between 50 and 100 g/l of sodium carbonate, at a temperature between 40° and 60° C., at a flow rate between 2.0 and 3.0 resin bed volumes per hour, in an upward or downward flow direction, and in a quantity between 2.0 and 4.0 resin bed volumes; and wherein the strong base anionic exchange resin can be protected with a weak base anionic exchange resin in a separate resin column placed upstream from the strong base anionic exchange resin, and the weak base anionic exchange resin is regenerated with effluent from the third step of the strong base anionic exchange resin regeneration.

2. The process according to claim 1, in which the sugar solution, after treatment with the strong base anionic exchange resin, is filtered to remove calcium carbonate precipitate from the solution.

3. The process according to claim 1, in which before the strong base anionic exchange resin is regenerated, the strong base anionic exchange resin is washed with water in an upward flow direction of the water, and bubbling air upward under pressure while the strong base anionic exchange resin is immersed in water, alternately, until the wash water becomes clear.

4. The process according to claim 1, wherein the first regeneration step is, at regular intervals of working cycles, followed by treatment of the strong base anionic exchange resin exteriorly of the resin column, in a separate vessel, by mixing the strong base anionic exchange resin with a solution of hydrochloric acid, at a concentration between 10 and 60 g/l of HCl, and at a temperature between 40° and 60° C., in an acid:resin volume ratio of at least 2:1.

5. The process according to claim 1, wherein the strong base anionic exchange resin is protected with a weak base anionic exchange resin in a separate resin column placed upstream from the strong base anionic exchange resin, and the weak base anionic exchange resin is regenerated with effluent from the third step of the strong base anionic exchange resin regeneration.

6. A process for decolorization and decalcification of a sugar solution, which comprises passing a sugar solution through a strong base anionic exchange resin in carbonate form wherein carbonate ions are bound to fixed ions of the resin, at a flow between 1.0 and 3.0 tons of dry substance of the solution per cubic meter of resin per hour and at a temperature between 60° and 80° C., in an up or down flow direction; and regenerating the strong base anionic exchange resin in three steps, in the first step by bubbling carbon dioxide upward through a bed of the resin to agitate the resin, using water and carbon dioxide until the effluent has a calcium concentration less than 200 ppm of calcium, expresses as CaO, in the second step by means of a sodium chloride solution, containing between 50 and 120 g/l NaCl, alkalinized with sodium hydroxide, sodium carbonate or ammonium hydroxide to a pH between 7.0 and 12.0, at a temperature between 40° and 60° C., at a flow rate between 2.0 and 3.0 resin bed volumes per hour, in an upward or downward flow direction, and in a quantity of 1.0 to 4.0 resin bed volumes, and in the third step by means of a sodium carbonate solution containing between 50 and 100 g/l of sodium carbonate, at a temperature between 40° and 60° C., at a flow rate between 2.0 and 3.0 resin bed volumes per hour, in an upward or downward flow direction, and in a quantity between 2.0 and 4.0 resin bed volumes; and wherein the strong base anionic exchange resin can be protected with a weak base anionic exchange resin in a separate resin column placed upstream from the strong base anionic exchange resin, and the weak base anionic exchange resin is regenerated with effluent from the third step of the strong base anionic exchange resin regeneration.

7. The process according to claim 6, wherein the first regeneration step is, at regular intervals of working cycles, followed by treatment of the strong base anionic exchange resin exteriorly of the resin column, in a separate vessel, by mixing the strong base anionic exchange resin with a solution of hydrochloric acid, at a concentration between 10 and 60 g/l of HCl, and at a temperature between 40° and 60° C., in an acid:resin volume ratio of at least 2:1.

8. The process according to claim 6, in which the sugar solution, after treatment with the strong base anionic exchange resin, is filtered to remove calcium carbonate precipitate from the solution.

9. The process according to claim 6, in which before the strong base anionic exchange resin is regenerated, the strong base anionic exchange resin is washed with water in an upward flow direction of the water, and bubbling air upward under pressure while the strong base anionic exchange resin is immersed in water, alternately, until the wash water becomes clear.

10. The process according to claim 6, wherein the strong base anionic exchange resin is protected with a weak base anionic exchange resin in a separate resin column placed upstream from the strong base anionic exchange resin, and the weak base anionic exchange resin is regenerated with effluent from the third step of the strong base anionic exchange resin regeneration.

* * * * *